US006982546B2

(12) United States Patent
Wu et al.

(10) Patent No.: US 6,982,546 B2
(45) **Date of Patent: *Jan. 3, 2006**

(54) HYBRID REACTIVE POWER COMPENSATION DEVICE

(75) Inventors: Chin-Chang Wu, Kaohsiung (TW); Hurng-Liang Chou, Kaohsiung (TW); Wen-Pin Hsu, Kaohsiung (TW); Yao-Jen Chang, Kaohsiung (TW)

(73) Assignee: UIS Abler Electronics Co., Ltd., Taipei Hsien (TW)

( * ) Notice: Subject to any disclaimer, the term of this patent is extended or adjusted under 35 U.S.C. 154(b) by 193 days.

This patent is subject to a terminal disclaimer.

(21) Appl. No.: 10/646,755

(22) Filed: Aug. 25, 2003

(65) Prior Publication Data

US 2004/0090212 A1 May 13, 2004

(30) Foreign Application Priority Data

Nov. 8, 2002 (TW) ..... 91133221 A

(51) Int. Cl.
*G05F 1/70* (2006.01)

(52) U.S. Cl. ..... 323/205; 323/208; 363/41

(58) Field of Classification Search ..... 323/205–210, 323/212, 217, 218; 363/39, 41, 46, 47; 307/105
See application file for complete search history.

(56) References Cited

U.S. PATENT DOCUMENTS

| | | | | |
|---|---|---|---|---|
| 4,503,380 | A * | 3/1985 | Thanawala | 323/206 |
| 5,434,497 | A * | 7/1995 | Larsen | 323/209 |
| 5,691,626 | A * | 11/1997 | Esser et al. | 323/209 |
| 5,804,949 | A * | 9/1998 | Othman et al. | 323/205 |
| 6,075,349 | A * | 6/2000 | Okayama | 323/207 |
| 6,329,798 | B1 * | 12/2001 | Huggett et al. | 323/207 |
| 6,573,691 | B2 * | 6/2003 | Ma et al. | 323/209 |
| 6,717,465 | B2 * | 4/2004 | Chou et al. | 330/149 |
| 6,876,178 | B2 * | 4/2005 | Wu et al. | 323/205 |

* cited by examiner

*Primary Examiner*—Gary L Laxton
(74) *Attorney, Agent, or Firm*—Bacon & Thomas PLLC

(57) ABSTRACT

A hybrid reactive power compensation device comprises a passive type reactive power compensator and an active type reactive power compensator serially connected thereto. The passive type reactive power compensator is an AC power capacitor adapted to provide the reactive power that reduces capacity of the active type reactive power compensator. The active type reactive power compensator comprises a power converter, a DC capacitor, a high-frequency ripple filter and a controller. The hybrid reactive power compensation device can supply a linearly adjustable reactive power within a predetermined range, and is adapted to supply a current with a nearly sinusoidal waveform. Therefore, it can avoid the destruction of AC power capacitor caused by the power resonance.

8 Claims, 4 Drawing Sheets

HYBRID REACTIVE POWER COMPENSATION DEVICE

BACKGROUND OF THE INVENTION

1. Field of the Invention

The present invention is related to a hybrid reactive power compensation device including a passive type reactive power compensator and an active type reactive power compensator serially connected thereto, which are adapted to supply a linearly adjustable reactive power within a predetermined range in the distribution power system. Moreover, the present invention is related to a hybrid reactive power compensation device including an active type reactive power compensator adapted to adjust a current flowing through the passive type reactive power compensator to be approximated as a sinusoidal waveform, and thereby it can avoid the power resonance generated between the passive type reactive power compensator and the reactance of power system that may cause destruction of the reactive power compensation device itself and adjacent power facilities.

2. Description of the Related Art

Most loads in a distribution power system have the characteristic of inductance, and it will result in a poor power factor. Hence, it requires a larger current for the identical real power that reduces the power efficiency of the distribution power system and degrades the performance of voltage regulation of the load side. For solving the above problems, power substations and power consumers generally install a passive type reactive power compensator (AC power capacitors) parallel connected to the distribution power system, so as to compensate a lagging reactive power to increase the entire power factor. In some distribution power systems, the capacity of applied AC power capacitors is about 25% to 35% of total capacity, and in some other distribution power system even exceeds about 50%, according to research reports.

Recently, harmonic pollution of industrial power system has increased seriously due to the wide use of nonlinear loads. The AC power capacitor for power factor correction provides a low impedance path for harmonic current, hence, the AC power capacitor is frequently damaged by harmonics. Meanwhile, it results in power resonance between the AC power capacitor and the distribution power system. A further result is the amplification of harmonic current and harmonic voltage. Thus, the destruction of the AC power capacitor due to over-voltage or over-current may occur. Besides, the over-voltage of AC power capacitor caused by the power resonance may destroy neighboring electric power facilities and even result in public accidents.

In order to solve the power resonance problem caused by the AC power capacitor, the voltage rating is increased to avoid the destruction of over-voltage in conventional solution. However, it cannot resolve the resonance problem and may, therefore, cause the destruction of neighboring power facilities.

There is another solution wherein the AC power capacitor is switched off from the power system when over-voltage or over-current occurs, but the function of reactive power compensation will be failed.

The reactive power compensation also can be obtained by using a set of constant AC power capacitors merely providing a fixed reactive power. This fixed reactive power cannot be adjusted to respond to the variation of loads, and it may result in over-voltage due to a light load. In order to properly adjust reactive power provided by the AC power capacitor, an automatic power factor regulator (APFR) is developed, as shown in FIG. 1. The APFR consists of a set of AC power capacitors C, through CN via switches S, through SN. Thereby the reactive power supplied from the APFR can be adjusted by changing number of AC power capacitors switched on. Although APFR can supply an adjustable reactive power to respond to the variation of loads, the APFR can merely be adjusted step by step not linearly. Therefore, the power factor of the distribution power system compensated by APFR still cannot be close unity.

Referring to FIG. 2, another power factor regulator uses a fixed capacitor parallel connected to a controllable reactor 11, which is controlled by a thyristor switch 10. This power factor regulator, so-called a Fixed Capacitor Thyristor-Controlled Reactor (FC-TCR), uses a phase control technique to control the thyristor switch 10, whereby it can provide a linearly adjustable reactive power. However, it generates a significant amount of harmonic current and results in serious harmonic pollution due to the use of the phase control technique in the thyristor.

The reactive power is adjustable in the two reactive power compensation devices described in preceding paragraphs, but the AC power capacitor thereof is parallel connected to a power system and it still cannot avoid the problem of destruction caused by the power resonance.

Referring to FIG. 3, a facility based on power electronic technology to be applied in a distribution power system to compensate reactive power, so-called the active type reactive power compensator 2, is shown. This active type reactive power compensator uses a power converter 20 via an inductor 21 to be connected to a power system 1. The power converter 20 is connected to a DC power capacitor 22 at its DC side. The active type reactive power compensator 2 may provide a leading reactive power or a lagging reactive power. The supplied reactive power can be adjusted linearly to respond to the variation of loads so that the input power factor can be maintained to be close to unity. Meanwhile, the active power factor correction system will not result in power resonance. Hence, it can avoid the destruction of the power resonance generated by an AC power capacitor. However, the active type reactive power compensator 2 must compensate the reactive power required by the loads, thus it requires a large capacity of power converter in the active type reactive power compensator. Hence, the wide application is limited due to the high cost.

The present invention intends to provide a hybrid reactive power compensation device used for supplying linearly adjustable reactive power within a predetermined range. Meanwhile, the hybrid reactive power compensation device includes an active type reactive power compensator to adjust a current flowing through a passive type reactive power compensator to be approximated as a sinusoidal waveform, and thereby it can avoid the power resonance generated between the hybrid reactive power compensation device and the reactance of power system. Therefore, it can avoid the destruction of hybrid reactive power compensation device itself and the neighboring power facilities by the power resonance. Moreover, the manufacture cost of the present invention is less expensive than that of the conventional active type reactive power compensator.

SUMMARY OF THE INVENTION

The primary objective of this invention is to provide a hybrid reactive power compensation device including a passive type reactive power compensator and an active type reactive power compensator serially connected thereto, which is adapted to supply a linearly adjustable reactive power and thereby avoid the destruction of power resonance. The manufacture cost of this invention is less expensive than that of the conventional active type reactive power compensator.

The hybrid reactive power compensation device in accordance with the present invention mainly comprises a passive type reactive power compensator and an active type reactive power compensator serially connected thereto. The passive type reactive power compensator is an AC power capacitor adapted to provide reactive power that, thus, reduces reactive power supplied from the active type reactive power compensator. Additionally, it can reduce the voltage rating and the capacity of active type reactive power compensator. Since the cost of AC power capacitor is less expensive significantly than that of the active type reactive power compensator, the manufacture cost of the present invention is also less expensive than that of the conventional active type reactive power compensator. The active type reactive power compensator comprises a power converter, a DC capacitor, a high-frequency ripple filter and a controller. The hybrid reactive power compensation device is adapted to supply linearly adjustable reactive power within a predetermined range. The hybrid reactive power compensation device can supply a current with a nearly sinusoidal waveform for reactive power compensation due to the use of active type reactive power compensator, and thereby it can avoid the power resonance generated by itself and reactance of the power system. Therefore, it can avoid the destruction of the hybrid reactive power compensator device itself and neighboring power facilities due to power resonance.

Other objectives, advantages and novel features of the invention will become more apparent from the following detailed description and the accompanying drawings.

BRIEF DESCRIPTION OF THE DRAWINGS

The present invention will now be described in detail with reference to the accompanying drawings herein.

DETAILED DESCRIPTION OF THE INVENTION

Figure 1:
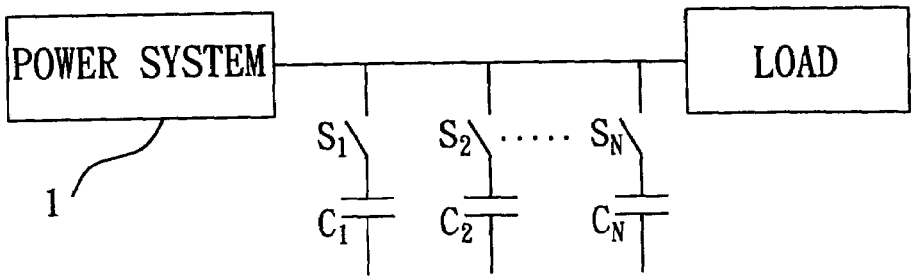
FIG. 1 PRIOR ART
FIG. 1 is a schematic view of a conventional automatic power factor regulator in accordance with the prior art.
Figure 2:
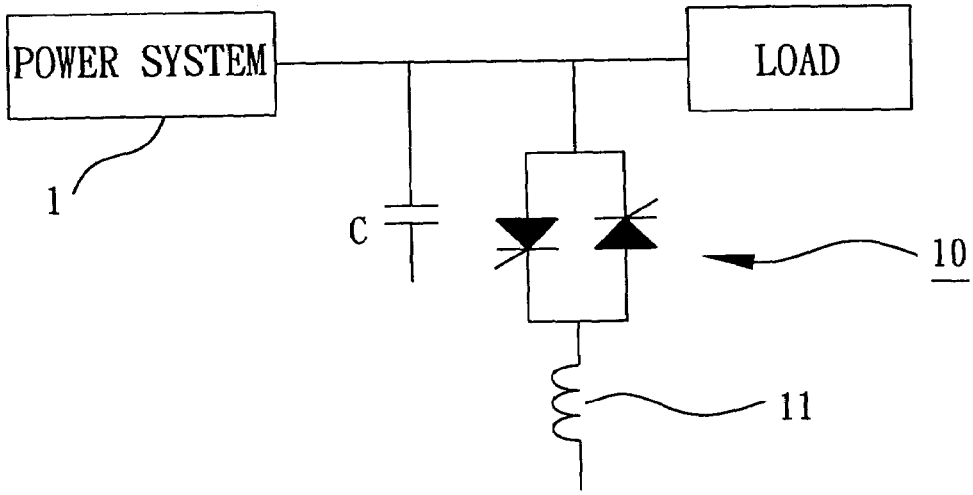
FIG. 2 PRIOR ART
FIG. 2 is a structural schematic view of a conventional fixed-capacitor thyristor-controlled reactor in accordance with the prior art.
Figure 3:
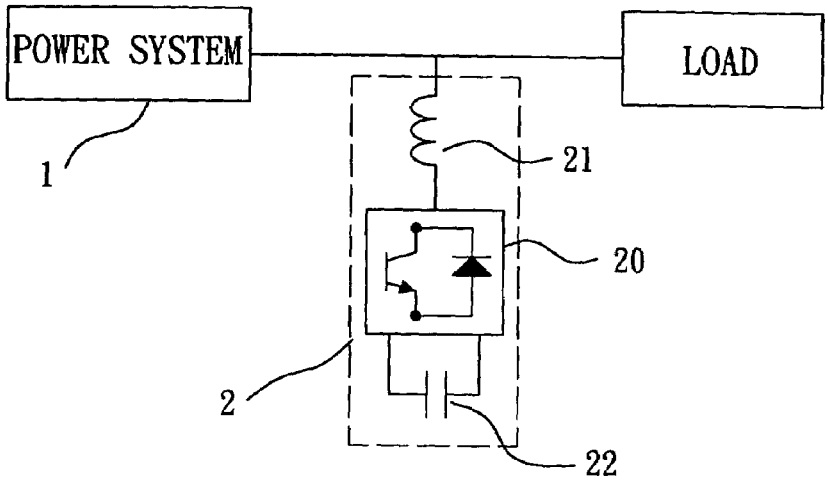
FIG. 3 PRIOR ART
FIG. 3 is a structural schematic view of a conventional active type reactive power compensator in accordance with the prior art.
Figure 4:
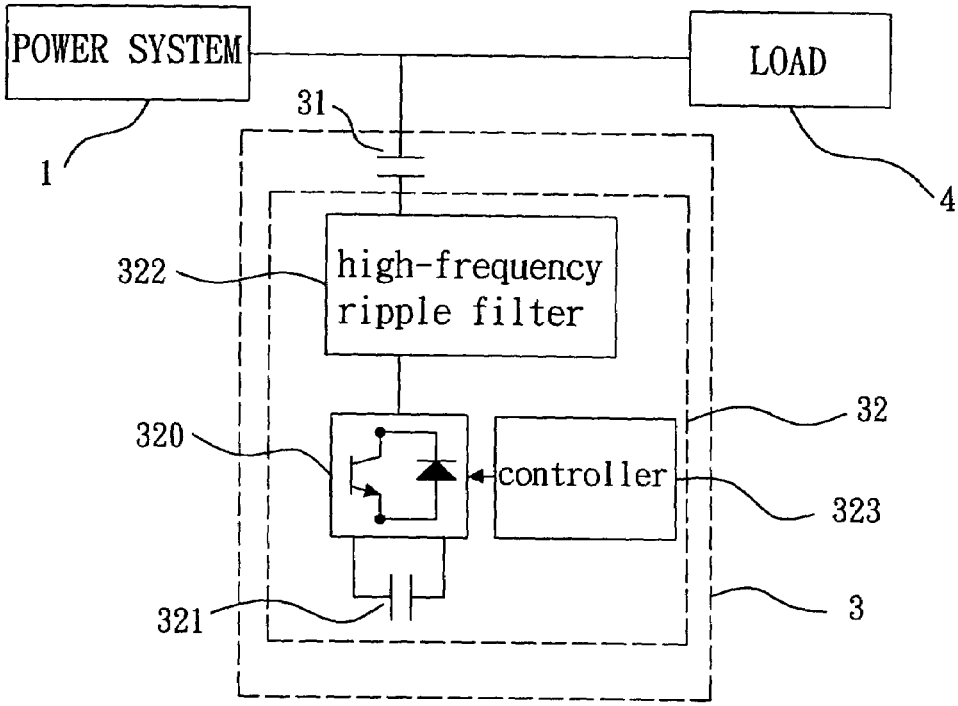
FIG. 4 is a structural schematic view of a hybrid reactive power compensation device in accordance with a first embodiment of the present invention.

FIG. 4 illustrates a system structure of a hybrid reactive power compensation device in accordance with the first embodiment of the present invention. Referring to FIG. 4, the hybrid reactive power compensation device 3 is parallel connected between a power system 1 and a load 4. The power system 1 provides an AC power to the load 4. The hybrid reactive power compensation device 3 is adapted to compensate the reactive power required by the load 4 to thereby improve the power factor from the view of power system 1. The hybrid reactive power compensation device 3 includes a passive type reactive power compensator 31 and an active type reactive power compensator 32 serially connected thereto. The passive type reactive power compensator 31 is a power capacitor adapted to supply the reactive power, thereby reducing the reactive power supplied from the active type reactive power compensator 32. The active type reactive power compensator 32 includes a power converter 320, a DC power capacitor 321, a high-frequency ripple filter 322 and a controller 323. The active type reactive power compensator 32 is used to linearly adjust the reactive power supplied from the hybrid reactive power compensation device 3 within a predetermined range. In addition, the active type reactive power compensator 32 can avoid the destruction of power resonance generated between the passive type reactive power compensator 31 and the impedance of power system 1.

Figure 5:
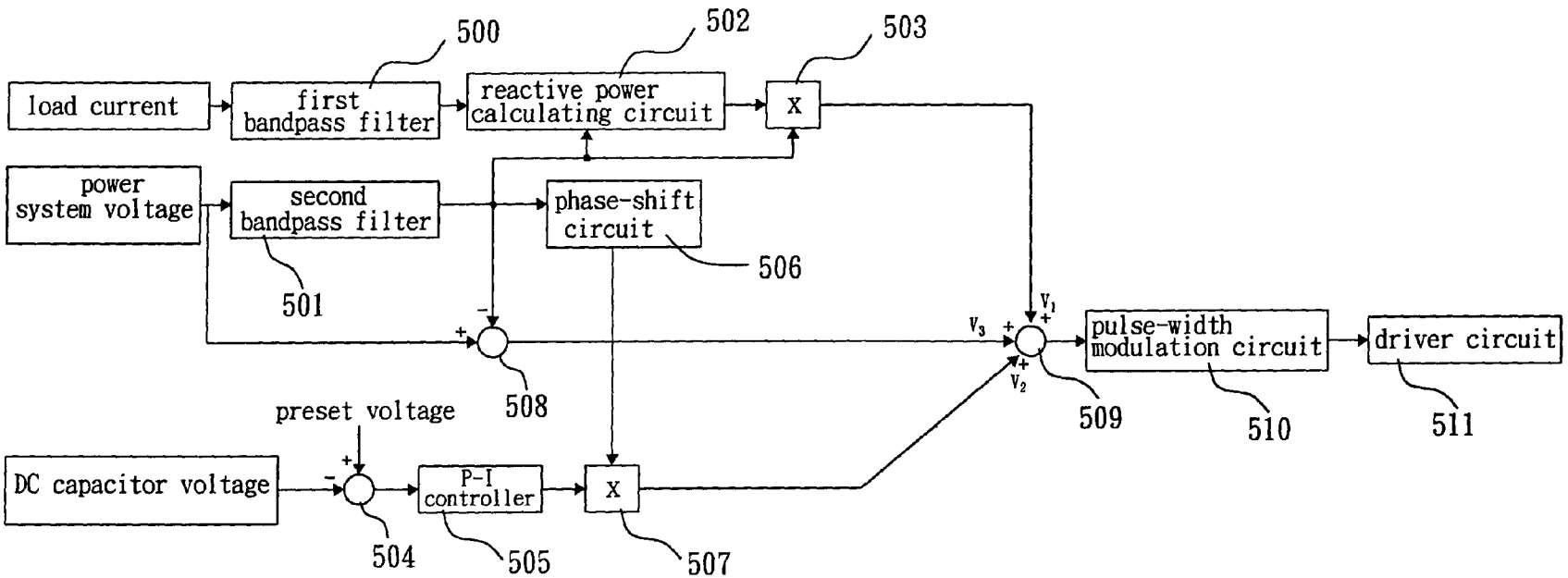
FIG. 5 is a control block diagram of active type reactive power compensator in accordance with the first embodiment of the present invention.

FIG. 5 illustrates a block diagram of the controller 323 of the active type reactive power compensator 32 in accordance with the first embodiment of the present invention. The active type reactive power compensator 32 is voltage controlled in a manner and principle as follows, Assuming that the voltage of the power system 1 is $$V_S = V_S \text{ Sin } \omega t \tag{1}$$

In order to adjust the reactive power of the hybrid reactive power compensation device 3, the active type reactive power compensator 32 must generate a fundamental voltage which is expressed as $$V_{a1} = V_{a1} \text{ Sin } \omega t \tag{2}$$

The voltage of two ends of the passive type reactive power compensator 31 becomes $$V_c = (V_s - V_a) \text{ Sin } \omega t \tag{3}$$

The reactive power supplied from the hybrid reactive power compensation device 3 is given by $$Q_r = Q_c(V_s - V_{a1}) \tag{4}$$

where $Q_r$ is the reactive power supplied from the hybrid reactive power compensation device 3, and $Q_c$ is the reactive power supplied from the passive type reactive power compensator (AC capacitor) 31 to the power system.

In Eq. (4), it can be found that the linearly adjusting compensation reactive power of the hybrid reactive power compensation device 3 is obtained by controlling the fundamental component of the active type reactive power compensator 32. The range of changing of the reactive power supplied from the hybrid reactive power compensation device 3 determines the amplitude of the voltage generated by the active type reactive power compensator 32.

Like the harmonic voltage ($V_h$) contained in the power system 1, the active type reactive power compensator 32 is adapted to supply a harmonic voltage which has the magnitude and phase equivalent to those of the power system 1. Consequently, the voltage of the passive type reactive power compensator 31 is supplied with a sinusoidal waveform only containing fundamental components to thereby avoid the power resonance generated by itself and reactance of the power system 1.

The present invention accomplishes to reduce the capacitance of the active type reactive power compensator 32 by means of the passive type reactive power compensator 31 providing a reactive power. Moreover, the active type reactive power compensator 32 is able to adjust the reactive power supplied from the hybrid reactive power compensation device 3 linearly within a predetermined range. Consequently, the active type reactive power compensator 32 is provided with a voltage equivalent to the harmonic voltage of the power system 1 so that the passive type reactive power compensator 31 can supply a current with a nearly sinusoidal waveform. Thereby, it can avoid resonance destruction between the hybrid reactive power compensation device 3 and the power system, and provide a reliable reactive power of the passive type reactive power compensator 31 and the active type reactive power compensator 32.

Referring again to FIGS. 4 and 5, the active type reactive power compensator 32 includes a controller 323. The active type reactive power compensator 32 adopts the voltage mode control and a modulation signal for controlling the active type reactive power compensator 32 can be obtained by adding three (first, second, and third) voltage control signals ($V_1$, $V_2$ and $V_3$).

Referring again to FIGS. 4 and 5, the first voltage control signal $V_1$ is adapted to adjust the reactive power linearly for tuning. The fundamental wave equal to the voltage of the power system 1 can be calculated by using Eq. (2). The load current is sent to the first band-pass filter 500 to obtain its fundamental component, and the voltage of power system is sent to the second band-pass filter 501 to obtain its fundamental component. Then, both outputs of the first band-pass filter 500 and the second band-pass filter 501 are fed to the reactive power calculating circuit 502. The reactive power calculating circuit 502 calculates and supplies the desired amplitude of reactive power voltage demanded by the hybrid reactive power compensation device 3. The outputs of the second band-pass filter 501 and the reactive power calculating circuit 502 are sent to a multiplier 503 for obtaining the first voltage control signal $V_1$.

Referring again to FIGS. 4 and 5, the second voltage control signal $V_2$ is used to regulate the voltage of the DC power capacitor 321 of the active type reactive power compensator 32 to thereby supply a DC voltage to the power converter 320. The active type reactive power compensator 32 has a power loss and thus the voltage of DC power capacitor 321 may be varied. In order to maintain the active type reactive power compensator 32 operating normally, the DC voltage thereof must be maintained at a constant value. In 10 this condition, the active type reactive power compensator 32 must absorb/generate real power from/to the power system 1. It means that the active type reactive power compensator 32 must generate a fundamental component voltage whose phase is identical with the voltage phase of the power system 1. The hybrid reactive power compensation device 3 is adapted to provide a reactive power and its current phase is 90 degrees leading the fundamental component of the power system voltage. Therefore, the second voltage control signal $V_2$ is a fundamental signal leading 90 degrees the power system voltage. The detected DC voltage of the active type reactive power compensator 32 and a preset voltage must be sent to a subtractor 504, and then the subtracted result is sent to the controller 505. The fundamental voltage of the second band-pass filter 501 derived from the power system is sent to the P-I controller 506 to thereby generate a fundamental signal leading 90 degrees. The output of the controller 505 and the output fundamental signal of the P-I controller 506 are sent to a multiplier 507 to obtain second voltage control signal $V_2$.

Referring again to FIGS. 4 and 5, the third voltage control signal $V_3$ is used to generate a voltage equivalent to the harmonic voltage of the power system 1. The voltage of the power system 1 and the output fundamental voltage of the second band-pass filter 501 are sent to a subtractor 508 so as to obtain its harmonic component. And then the harmonic component is sent to a second amplifier 509, thereby obtaining the third voltage control signal $V_3$. After that, the three voltage control signals ($V_1$, $V_2$ and $V_3$) are added in an adder 509 and the output of the adder 509 is passed to a second controller 510 to obtain a modulation signal. And then the modulation signal is sent to a pulse-width modulation circuit 510 to generate the pulse-width modulation signal that is sent to a driver circuit 511. Consequently, the driving signals of the power converter 320 of the active type reactive power compensator 32 can be obtained.

Figure 6:
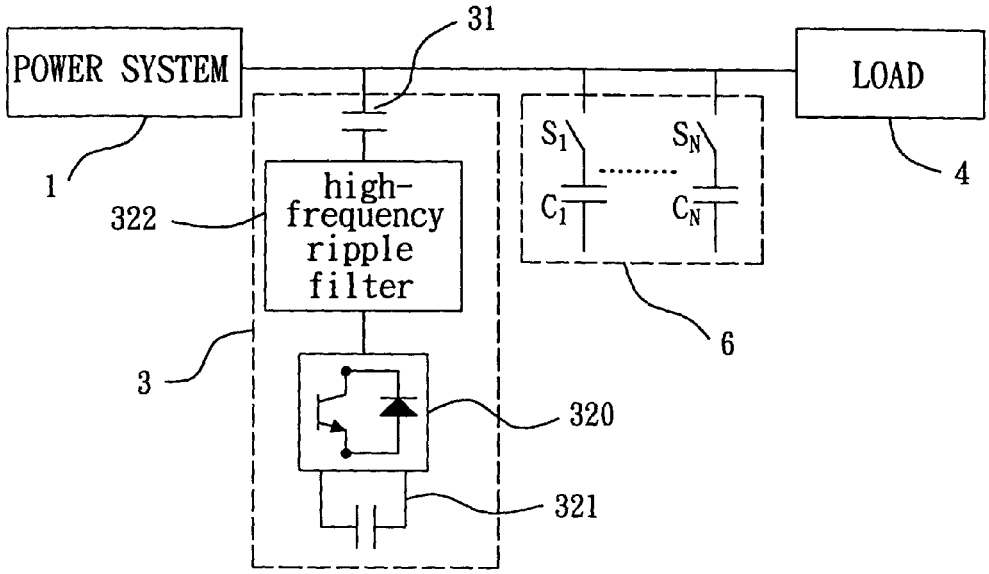
FIG. 6 is a structural schematic view of a parallel connection of a hybrid reactive power compensation device with an automatic power factor regulator system in accordance with a second embodiment of the present invention.

Referring to FIG. 6, it is illustrated that the second embodiment includes the hybrid reactive power compensation device 3 of the first embodiment and an automatic power factor regulator system (APFR system) 6 connected parallel thereto. The connected hybrid reactive power compensation device 3 and APFR system 6 are parallel connected between the power system 1 and the load 4. The power system 1 supplies the AC power to the load 4. The combination of the hybrid reactive power compensation device 3 and the APFR system 6 is used to supply the reactive power for compensating the reactive power demanded by the load 4. The APFR system 6 adjusts the reactive power step by step for rough tuning, and the hybrid reactive power compensation device 3 adjusts the reactive power linearly for fine tuning to improve the input power factor to be close to unity. Thus the capacity of the hybrid reactive power compensation device 3 is reduced. Consequently, the second embodiment merely requires a relatively small capacity of the hybrid reactive power compensation device 3 to incorporate into the APFR system 6 and it can linearly adjust the reactive power for improving the power factor.

Figure 7:
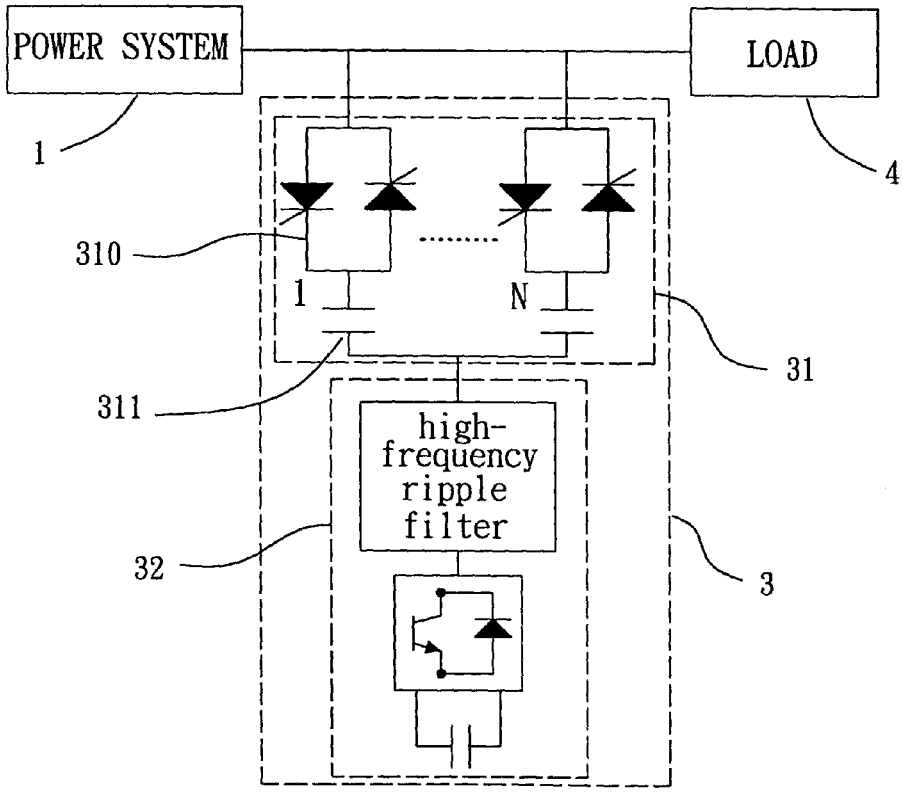
FIG. 7 is a structural schematic view of a hybrid reactive power compensation device in accordance with a third embodiment of the present invention.

Referring to FIG. 7, it is illustrated that the hybrid reactive power compensation device 3 of the third embodiment is parallel connected between the power system 1 and the load 4. The power system 1 supplies an AC power to the load 4. The hybrid reactive power compensation device 3 is used to supply the reactive power demanded by the load 4. The hybrid reactive power compensation device 3 improves the input power factor to be close to unity. The hybrid reactive power compensation device 3 includes a passive type reactive power compensator 31 and an active type reactive power compensator 32 serially connected thereto. The passive type reactive power compensator 31 may be a thyristor switch assembly 310 and an AC power capacitor assembly 311 serially connected thereto to form a Thyristor Switch Capacitor (TSC). In practical application, the hybrid reactive power compensation device 3 can be operated with different step numbers of the AC power capacitor 311 therein by means of switching the thyristor switch assembly 310 that accomplishes rough tuning for adjusting reactive power. Moreover, it can adjust the reactive power for fine-tuning by means of the active type reactive power compensator 32 that improves the input power factor to be close to unity. The active type reactive power compensator 32 applies a control method of the first embodiment that generates current with a fundamental waveform. Consequently, the AC power capacitor assembly 311 formed in the passive type reactive power compensator 31 can avoid the destruction caused by the power resonance.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A hybrid reactive power compensation device parallel-connected to a power system to provide reactive power to thereby improve the power factor, comprising:

a passive type reactive power compensator; and an active type reactive power compensator serially connected to the passive type reactive power compensator;

wherein the passive type reactive power compensator provides the reactive power so that power capacity of the active type reactive power compensator is reduced; the active type reactive power compensator of the hybrid reactive power compensation device can supply a linearly adjustable reactive power within a predetermined range; the active type reactive power compensator is adapted to provide a current with a nearly sinusoidal waveform for reactive power compensation, thereby avoiding destruction of the passive type reactive power compensator caused by a power resonance.

2. The hybrid reactive power compensation device as defined in claim 1, wherein the passive type reactive power compensator is an AC power capacitor or a thyristor switching capacitor.

3. The hybrid reactive power compensation device as defined in claim 2, wherein the passive type reactive power compensator is a thyristor switching capacitor, which is used to supply the adjustable reactive power for rough tuning; and wherein the active type reactive power compensator is used to supply the adjustable reactive power for fine tuning so that the power factor of a distribution power system can be close unity.

4. The hybrid reactive power compensation device as defined in claim 1, wherein the active type reactive power compensator is consisted of a power converter, a DC power capacitor, a high-frequency ripple filter and a controller.

5. The hybrid reactive power compensation device as defined in claim 1, wherein the active type reactive power compensator adopts a voltage mode control.

6. The hybrid reactive power compensation device as defined in claim 5, wherein the active type reactive power compensator includes a power converter adapted to generate a voltage which comprises first, second, and third voltage control signals.

7. The hybrid reactive power compensation device as defined in claim 5, wherein the first voltage control signal is adapted to accomplish a function for adjusting reactive power and has a fundamental voltage control signal in phase with a voltage of a power system; the second voltage control signal is adapted to regulate a DC power capacitor of the power converter and has a sinusoidal signal leading with the voltage signal of fundamental component of the power system by 90 degrees; the third voltage control signal is adapted to supply a harmonic voltage which has the magnitude and phase equivalent to harmonic component of the power system, the harmonic voltage eliminates the harmonic component of the power system so that the passive type reactive power compensator provides with a voltage and a current with a nearly sinusoidal waveform to thereby avoid destruction of the passive type reactive power compensator caused by a power resonance.

8. The hybrid reactive power compensation device as defined in claim 1, wherein the hybrid reactive power compensation device is parallel connected to an automatic power factor regulator system, the automatic power factor regulator system is able to adjust the reactive power for rough tuning, and the hybrid reactive power compensation device can supply a sinusoidal current to linearly adjust the reactive power for fine tuning that it can improve the input power factor to be closed to unity, thereby reducing the capacity of the hybrid reactive power compensation device.

* * * * *